US006098221A

United States Patent [19]

Kloppenborg

[11] Patent Number: 6,098,221

[45] Date of Patent: Aug. 8, 2000

[54] CONFORMING BODY SUPPORT WITH AIR CHAMBER AND PUMP CHAMBER

[76] Inventor: Patrick Kloppenborg, Vlielandlaan 4, 8443 CZ Heerenveen, Netherlands

[21] Appl. No.: 09/130,161

[22] Filed: Aug. 6, 1998

[30] Foreign Application Priority Data

Aug. 7, 1997 [NL] Netherlands ..... 1006737
Oct. 30, 1997 [NL] Netherlands ..... 1007398

[51] Int. Cl.[7] ..... A47C 27/08

[52] U.S. Cl. ..... 5/706; 5/714

[58] Field of Search ..... 5/673, 706, 714, 5/724, 739, 652.1, 654

[56] References Cited

U.S. PATENT DOCUMENTS

| | | | |
|---|---|---|---|
| 2,750,606 | 6/1956 | Freedlander et al. . | |
| 3,792,501 | 2/1974 | Kery . | |
| 4,169,295 | 10/1979 | Darling . | |
| 4,306,322 | 12/1981 | Young et al. | 5/706 X |
| 5,033,133 | 7/1991 | Nissen . | |
| 5,367,726 | 11/1994 | Chaffee | 5/706 |
| 5,416,935 | 5/1995 | Nieh | 5/706 X |
| 5,467,489 | 11/1995 | Cchen . | |
| 5,469,592 | 11/1995 | Johnson . | |
| 5,586,347 | 12/1996 | Frischknecht . | |
| 5,746,873 | 5/1998 | Graf . | |
| 5,815,865 | 10/1998 | Washburn et al. | 5/706 X |

FOREIGN PATENT DOCUMENTS

| | | |
|---|---|---|
| 2173478 | 9/1995 | Canada . |
| 0 146 856 | 12/1984 | European Pat. Off. . |
| 1007398 | 3/1994 | Germany . |
| 2 287 402 | 9/1995 | United Kingdom . |
| WO 86/03106 | 6/1986 | WIPO . |
| WO 92/07540 | 5/1992 | WIPO . |
| WO 93/21803 | 11/1993 | WIPO . |
| WO 94/05188 | 3/1994 | WIPO . |
| WO 95/09552 | 4/1995 | WIPO . |
| WO 95/25455 | 9/1995 | WIPO . |
| WO 95/28112 | 10/1995 | WIPO . |
| WO 95/31920 | 10/1995 | WIPO . |
| WO 96/04825 | 2/1996 | WIPO . |
| WO 96/29917 | 10/1996 | WIPO . |

*Primary Examiner*—Terry Lee Melius
*Assistant Examiner*—James M Hewitt
*Attorney, Agent, or Firm*—Varnum, Riddering, Schmidt & Howlett LLP

[57] ABSTRACT

Body support having an air core (2, 3; 52) and a bellows (6, 7; 56), integrated into a side edge portion (4, 5) from a compliant filling material, and having compliant filling material in an inner space. The body support further comprises passages (13, 14, 15; 63, 64, 65) which connect the bellows (6, 7; 56) with the air core (2, 3; 52) and connect the bellows (6, 7; 56) and the air core (2, 3; 52) with the surroundings, and comprising valves (16, 17; 67, 70) for blocking in a condition of rest air flow from the air core (2, 3; 52). Because the inner space of the bellows (6, 7; 56) in the condition of rest is in open communication with the surroundings, the compressibility of the bellows filled with filling material is well adapted to the compressibility of adjacent side edge portions, which are also filled with filling material, and the maximum load of the bellows is limited.

8 Claims, 3 Drawing Sheets

CONFORMING BODY SUPPORT WITH AIR CHAMBER AND PUMP CHAMBER

FIELD AND BACKGROUND OF THE INVENTION

This invention relates to a conforming body support with an air core.

In such a body support in the form of a mattress, an air core is used to obtain good conformity to the body of a user lying on the mattress. This principle, however, can also be used for other body supports, such as seat cushions and pillows. In comparison with, for instance, a water bed, the advantage is obtained that the mattress is considerably lighter does not need to be heated, involves less after-undulation, and that in case of leakage no water damage occurs.

International patent application WO 93/21803 discloses such a body support, having an outer contour and, within that outer contour, an air core, a side edge portion, contiguous to the air core, from a compliant filling material, and a bellows, integrated into that side edge portion, which in a condition of rest is airtightly separated from the air core and has compliant filling material in an inner space. The body support further comprises a system of passages which connects the bellows with the air core and connects the bellows and the air core with the surroundings, and a valve system for blocking, at least in the condition of rest, air flow from the air core.

For the air pressure in the air core—which, in practice, like a pneumatic tire, is not absolutely airtight—to be kept at a constant level, in mattresses according to this document the bellows are coupled to a buffer reservoir, Arranged between the buffer reservoir and the air core is a settable pressure reducing valve, which allows air to pass from the buffer reservoir to the air core if the overpressure in the air core relative to the surroundings decreases below a particular value. This means that the air core is replenished from the buffer reservoir depending on the pressure in the mattress in unloaded condition, In loaded condition the pressure in the air core is higher than in unloaded condition. The pumping of air to the buffer reservoir in use occurs automatically by compression and expansion of bellows, incorporated into the aide edge, when sitting down on the edge of the mattress, for instance when getting into and out of bed.

A drawback of this body support is that the buffer reservoir must be pumped up against an elevated overpressure, so that the bellows constitute relatively stiff elements in the edge of the body support, which feel unpleasant when sitting down on the edge of the body support, and which further have an adverse effect on the lying or sitting comfort in the edge area of the body support. Furthermore, the bellows and the buffer reservoir are subject to heavy loads when the mattress is used roughly, for instance when children jump or dive on it, especially when the pressure in the buffer reservoir is high. Preventing damage to the bellows therefore requires a robust construction.

The overpressure in the air core is very low in unloaded condition and is influenced by objects lying on the bed such as blankets and/or quilts, as well as by fitted sheets stretched onto the mattress. The overpressure in the air core in unloaded condition is therefore difficult to control and, owing to the disturbances referred to, less suitable as a measure for the hardness of the mattress. Finally, with such a mattress, getting into and out of bed is often accompanied by attendant noises due to the air displacement from the bellows to the buffer chamber.

International patent application WO 95/09552 discloses another body support with an air core, designed as a mattress, in which the bellows are formed by a corner area of the air core, The bellows communicate via a permanently open aeration opening with the rest of the air core. This aeration opening is so small that air flowing back through it does not substantially slow down inflation. The suction passage for admitting air to the bellows is intermittently closed of f during pumping by the user who places the member of his body with which he compresses the bellows, in front of the suction opening. After inflation of the air core the suction passage is closed hermetically and a residual pressure difference between the bellows and the rest of the air core is equalized via the aeration passage.

Although the pressure in the bellows-shaped portion of the air core in the condition of rest is basically equal to the pressure in the rest of the air core, the spring characteristic of the bellows-shaped portion of the air care differs considerably from the spring characteristic of the rest of the air core. Upon compression of the rest of the air core, air is displaced. Displacement of air, upon compression of the bellows portion of the air core, is to proceed via the aeration passage and the pumping passage. For the purpose of rapid displacement of air, the aeration passage cannot play a significant role because otherwise the air core would deflate too fast during inflation. If the pumping passage is small, hardly any air can be displaced upon loading of the bellows portion. The bellows portion of the air core is then relatively hard and the bellows are heavily loaded upon strong local compression. If, conversely, the pumping passage is large, a reasonable volume of air is displaced, but after compression of the bellows it takes quite some time for the shape thereof to be restored again, since via the aeration opening per unit of time only little air can flow to the bellows portion.

Further, regulating the pressure of such mattresses is laborious because the suction passage must each time be closed off with a cap prior to test-lying.

SUMMARY OF THE INVENTION

The object of the invention is to provide a body support with an air core, in which the bellows as to compressibility at given loads are better adapted to the surrounding portions of the body support, in which, upon extreme local application of force to the body support in the area of the bellows, the bellows are not loaded particularly heavily and yet expand fast again, and in which less attendant noise occurs upon local loads that occur, for instance, when getting into and out of bed, and when sitting down in a chair.

This object is achieved by providing that in the body support with an integrated inflating bellows, the inner space of the bellows in the condition of rest is in open communication with the surroundings.

As a result, upon compression of the body support in the area of the bellows without the intention of pumping up the body support, air can flow out of the bellows and back into the bellows when the bellows expand again. By choosing a suitable kind of filling material in the bellows and of a suitable structure, the compressibility of the bellows can therefore be simply adapted to the compressibility of surrounding portions of the body support and in particular to the compressibility of adjacent side edge portions from compliant filling material. Because upon a sudden, strong compression of the bellows, air can escape from the bellows to the surroundings, the load on the bellows upon sudden compression remains limited, and the risk of damage to the bellows when the body support is being jumped on or so, is greatly reduced.

Because the communication between the inner apace of the bellows and the surroundings can unobjectionably take place via a large passage area, a large volume of air can be displaced fast and at relatively low flow velocities from the bellows to the surroundings and flow from the surroundings to the bellows again. Attendant noises upon compression of the body support in the area of the bellows thus remain limited.

Particular embodiments of the body support according to the invention are set forth in the dependent claims.

Hereinafter, further objects, embodiments, effects and advantages of the invention are described and explained on the basis of an exemplary embodiment presently preferred most and a few variants, with reference to the drawings.

DETAILED DESCRIPTION

Figure 1:
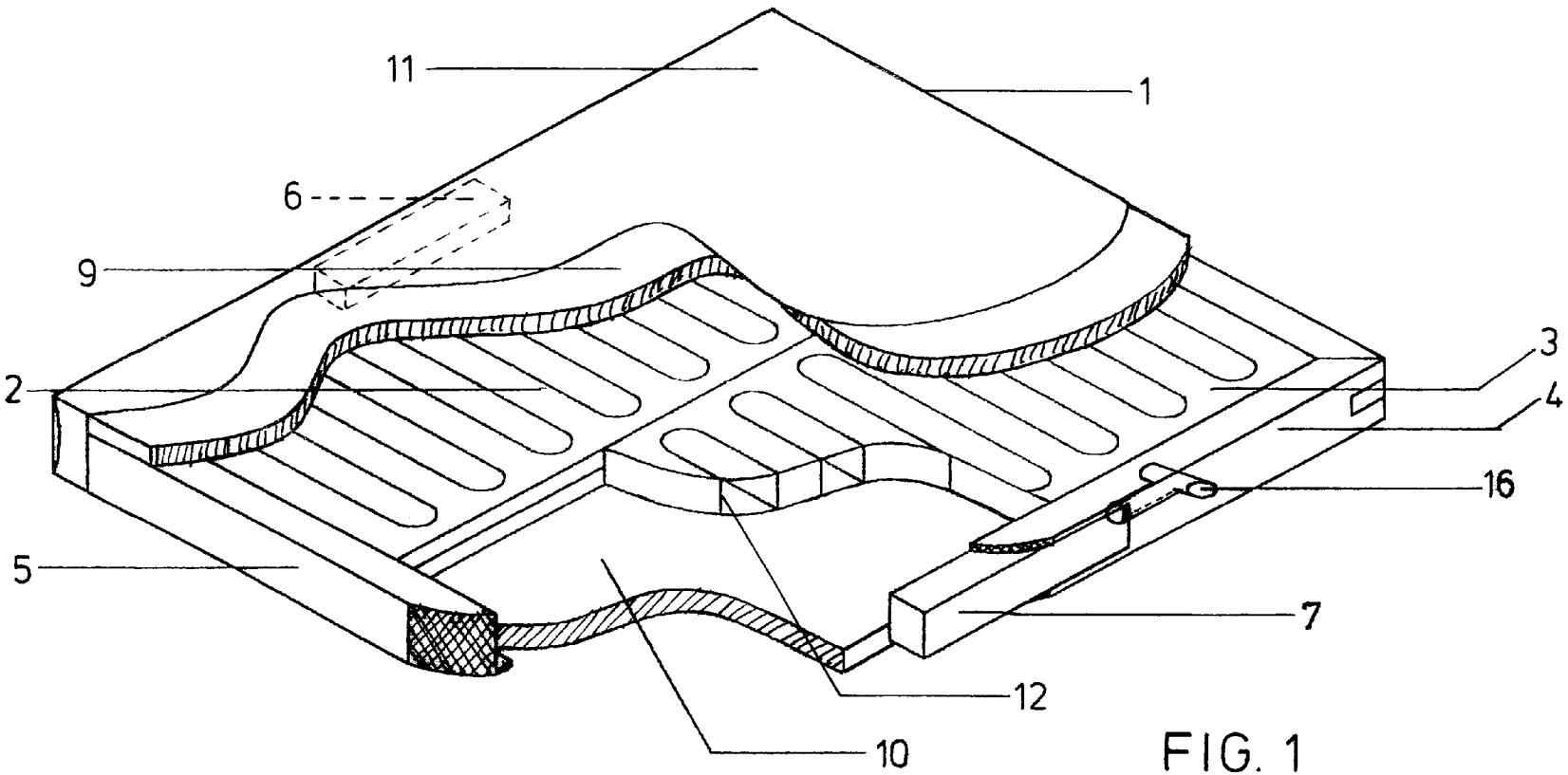
FIG. 1 is a schematic perspective and cutaway view of an example of a mattress according to the invention.
Figure 2:
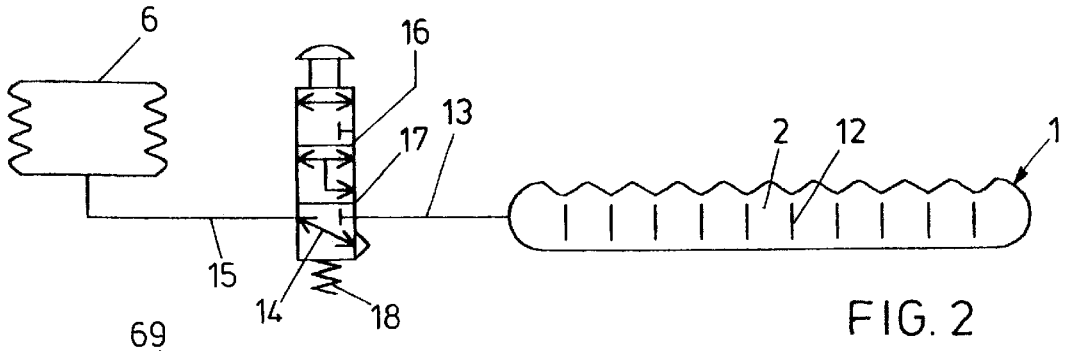
FIG. 2 is a schematic representation of an example of a mattress according to the invention and in particular of the pumping system thereof.
Figure 4:
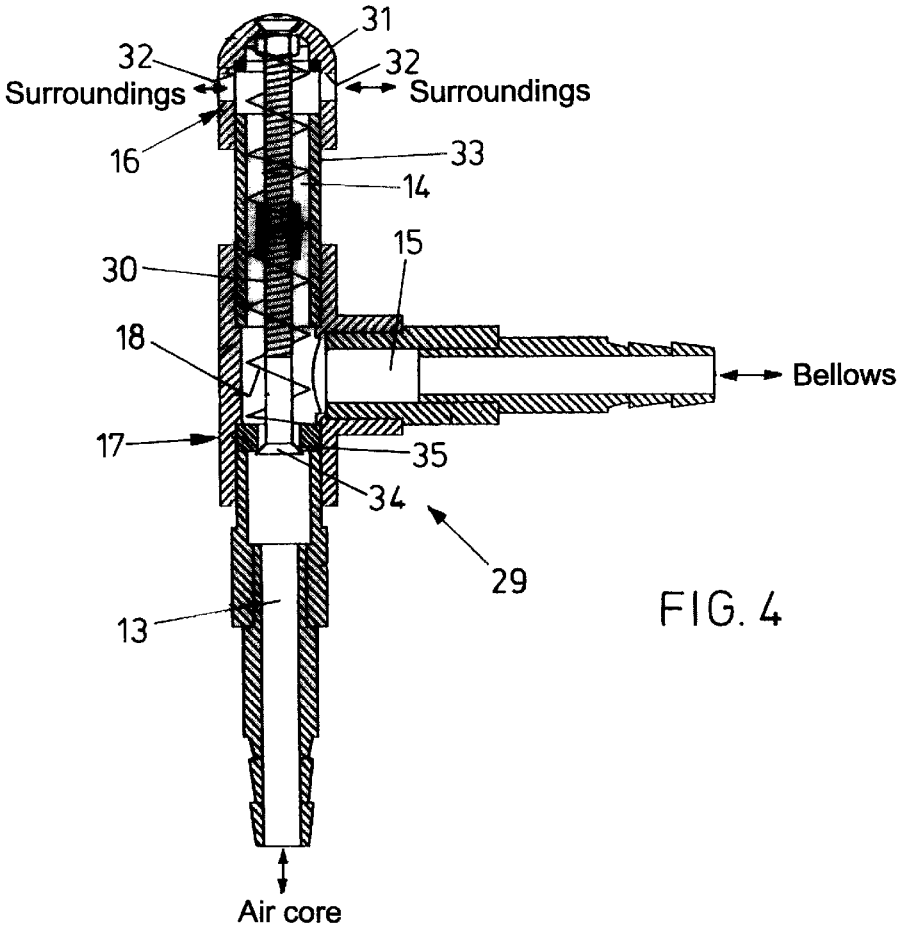
FIG. 4 is a sectional view of an assembly of valves and ports, which is part of a mattress according to FIG. 2.
Figure 5:
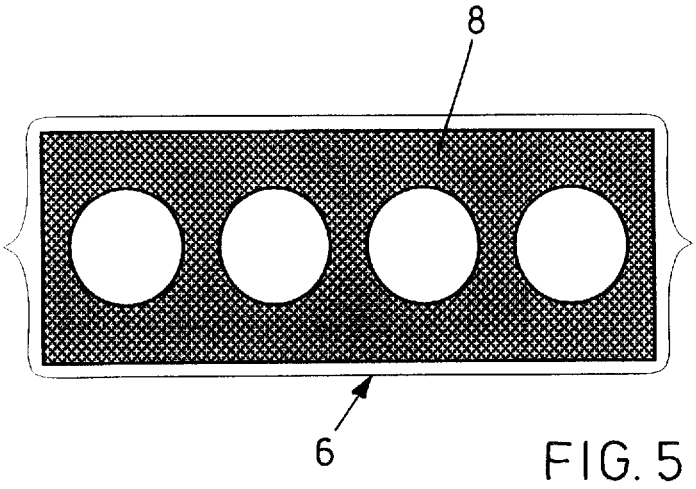
FIG. 5 is a sectional view of a bellows of a mattress according, to the invention.

The invention will first be described in more detail on the basis of an exemplary embodiment presently preferred most, which is formed by the mattress as shown in FIG. 1 and the design of parts thereof as shown in FIGS. 2, 4 and 5.

The mattress shown in FIG. 1 has a generally rectangular outer contour 1 and is designed as a double mattress. Of course, as is conventional, the mattress can be designed in different lengths and widths for use by one or two persons. Further, a segmented design adapted for beds having a sitting position is possible. Accommodated within the outer contour 1 of the mattress shown are two air cores 2, 3 (chambers filled with air in operative condition), side edge portions 4, 5 from a compliant filling material which are contiguous to the air cores 2, 3, and bellows 6, 7, which are integrated into the side edge portions 4, 5, in the condition of rest are airtightly separated from the air cores 2 and 3, respectively, and contain compliant filling material 8 (see FIG. 5) to cause the bellows 6, 7 to re-swell after compression.

The separated air cores 2, 3 each with an associated pumping bellows 6, 7, respectively, make it possible to adjust the left and right half of the mattress to the individual users.

Further, the mattress is provided with a "topping" 9 from polyether, which provides for the removal of perspiration and which makes for increased comfort. Located under the air cores 2, 3 is a bottom 10 which serves as heat insulation, sound damper (the air chambers constitute acoustic boxes), as protection of the air cores 2, 3 and as protection of the bed bottom upon very local loading of the mattress (e.g. when standing on the mattress). The outer layer of the contour 1 is formed by a mattress sleeve 11 which is removable to enable Assembly of the mattress as well as cleaning and replacement of parts of the interior.

The air cores 2, 3 are provided with partitions 12 which upon loading of an area of the mattress prevent excessive bulging of other areas of the mattress.

The mattress further comprises systems of passages 13, 14, 15 which connect the bellows 6, 7 with the associated air cores 2 and 3, respectively, and which connect the bellows 6, 7 as well as the air cores 2, 3 with the surroundings. FIGS. 2 and 4 represent one of those systems of passages 13, 14, 15 associated with one of the air cores. The systems of passages 13, 14, 15 include valve systems 16, 17 for blocking, in the condition of rest, air flow away from the air cores 2, 3. The valves 16, 17 are urged into the condition of rest shown in FIGS. 2, 4 by a spring 1B. In the condition of rest shown, the inner space of each of the bellows 6, 7 communicates freely with the surroundings.

The mattress feels little different in the area of either of the bellows 6, 7 than in other portions of the edge areas 4, 5, in that the bellows 6, 7 are filled with a filling material 8 which, as to its compliance, is attuned to the filling material from which the rest of the side edge portions 4, 5 are formed and in that upon compression of the bellows 6, 7 air can readily escape to the surroundings via the passages 13, 15 of ample dimensions. Because upon application of large local forces to the bellows 6, 7, air can easily escape from the bellows, the overpressure that may arise in the bellows in such situations is limited. The maximum loading of the bellows is thus limited. The bellows 6, 7, for that matter, are formed by a sleeve of vinyl which has been fitted around a block of polyether and has been sealed. In the polyether 8 holes have been provided to increase the effective stroke volume of the bellows 6, 7.

In normal use, the flow velocities in the passages 13, 15 between the bellows 6, 7 and the surroundings remain limited, and air flows through these passages only for a very short time, until a new equilibrium has been achieved. The occurrence of disturbing sounds thus remains limited at normal loading of the mattress.

In each of the bellows 6, 7, the associated suction passage 14, 15 constitutes both the connection between the bellows 6, 7 and the surroundings via which the bellows 6, 7 in the condition of rest communicates with the surroundings, and the connection between the bellows 6, 7 and the surroundings via which the bellows 6, 7 take in air from the surroundings during pumping. Thus, it sufficed to provide only a single connection between the bellows 6, 7 and the surroundings.

The suction passage via which during inflation of the bellows air is drawn in from the surroundings and which upon each compression of the bellows must be closed off, need not be provided with a valve for intermittently closing off that passage during pumping. As is known per se from international patent application WO 95/09552, the auction passage can, during pumping, be closed off each time the bellows are compressed, by the foot, the hand or any other object with which the bellows are compressed.

In the mattress according to FIGS. 1, 2, 4 and 5, however, the valve system is equipped with valves 16, open in the condition of rest, for closing the open connection between the bellows 6, 7 and the surroundings when the bellows 6, 7 in question are being compressed during inflation of the air core.

When the valve 16 is closed, the valve 17 is automatically opened to remove the blocking of air flow from and to the associated air core 2, 3. By subsequently compressing the bellows 6, 7, air is displaced from the bellows 6, 7 to the associated air chamber 2, 3. By releasing the valve system 16, 17 just before the bellows expand, the valves 16, 17 return to the depicted position and the bellows 6, 7 draw in air from the surroundings. At the next pumping stroke, the valve system must now be set in the position again there the outlet 14 to the surroundings is blocked and the passages 13, 15 between the bellows 6, 7 and the associated air core are opened. For fine-tuning the pressure in the air core 2, 3 in question, it is sufficient to compress the associated bellows 6, 7 once or a few times. It is therefore not objectionable that the valve 16 prior to compression of the associated bellows 6, 7 must be operated each time to close it and, after the compression of the bellows 6, 7 in question, must be operated to open it.

The single channels 13, 14 between each of the air cores 2, 3 and the surroundings each form both a pumping passage and a blow-off passage, so that during manufacture only one channel needs to be connected to each of the air chambers 2, 3. The valve system 16, 17, in the condition of rest, then closes off only a single channel between each of the air cores 2, 3 and the surroundings in both directions of passage, so that it is simple in structure.

To allow air to escape from either of the air cores 2, 3, the valve system 16, 17 in question can be set in an intermediate position, in which the valve 17 in the channel section 13 leading to the air core 2, 3 is opened, but the valve 16 in the channel section 14 leading to the surroundings is not closed.

Because the valves 16, 17 in the pumping passage 13, 14 at the same time constitute the valves in the blow-off passage 13, 14, and each, in open condition, permit the passage of air in two opposite directions, blowing off air from the air chambers 2, 3 does not require any further operating action and an for the valves 16, 17 a simple design will suffice.

As can be seen in FIG. 4, the valves 16, 17 are included in a T-piece 29 with three legs which form portions of the channel sections 13, 14, 15 leading to the surroundings, the associated bellows 6, 7 and the associated air chamber 2, 3. In the T-piece a valve member 30 is suspended for reciprocation, which fulfills all shut-off functions of the mattress. The valve member 30 extends in the channel sections 13, 14 in the direction of the surroundings and in the direction of the associated air core 2, 3, and in the condition of rest shown closes off the channel section 13 in the direction of the associated air core 2, 3. In a pumping position, in which the valve member 30 has moved down and the spring 18 is compressed, the valve member 30 closes off the channel section 14 in the direction of the surroundings, while the channel section 13 in the direction of the associated air core 2, 3 is released. In the blow-off position in-between the positions mentioned, the valve member 30 releases the channel Sections 13, 14 in the directions of both the surroundings and the associated air core 2, 3.

The T-piece can be manufactured in small series and large dimensions at acceptable cost by assembling it substantially from standard PVC components used for water drainage. Of course, if the size of series is sufficient, more integrated one-piece parts can be used. The valve member 30 has an end 31 which is designed as a cap with passages 32. In the condition of rest shown, the passages 32 are located beyond the end of a wall 33 which bounds the channel section 14 leading to the surroundings, and overlap that wall 33 in depressed condition. Thus the channel section 14 can be closed off by depressing the cap 31.

The other end of the valve member 30 is provided with a valve disc 34 which in the condition of rest abuts against a valve seat 35, and is clear of the valve seat 35 when the valve member is depressed.

Thus, with a single valve member 30 simple to operate, a valve has been obtained which can assume three operating positions by operation of a single operating member (the cap 31).

Figure 3:
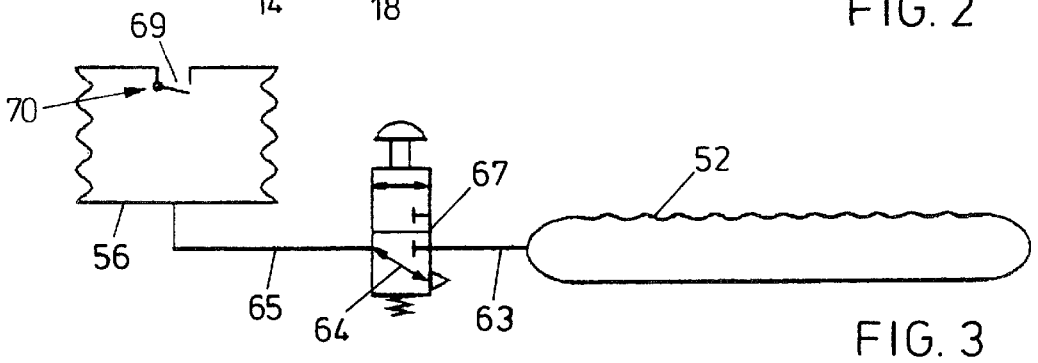
FIG. 3 is a schematic representation of a second example of a mattress according to the invention and in particular of the pumping system thereof.
Figure 6:
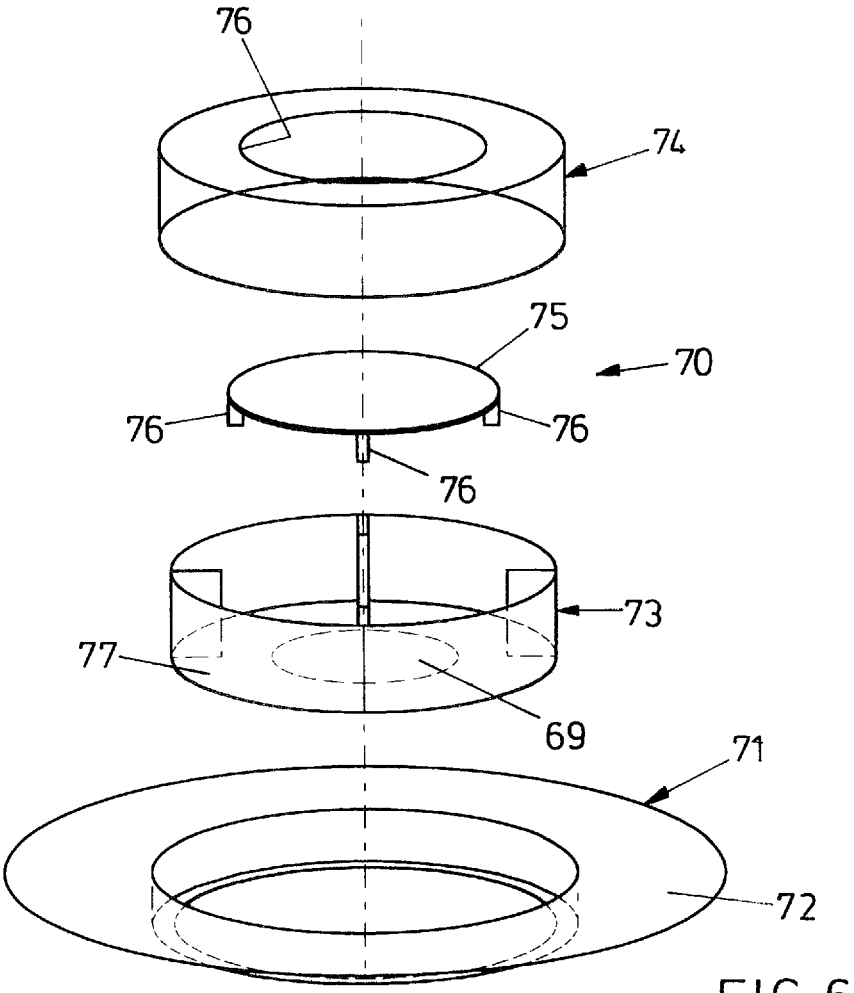
FIG. 6 is a schematic perspective and exploded view of a valve for use as a non-return valve in a suction passage opening into the bellows.

FIG. 3 shows A variant in which the bellows 56 communicate via passages 64, 65 with the surroundings when a valve 67 is in the condition of rest. The bellows 56 are provided with a separate auction passage 69 in which a valve 70 is disposed. This valve is shown in more detail in FIG. 6.

This valve 70 is made up of a bearing ring 71 with a flange 72 which can be welded to material of the bellows 6, 7. In the bearing ring 71 a valve housing can be placed which consists of a bottom part 73 and a cap part 74 which fits over the bottom part 73 and can be mounted in the ring 71. Confined within the housing is a closing plate 75 which is reciprocable between an upper position, in which a passage 76 in the cap part 74 is closed off and a lower position in which the passage 76 and the passage 69 in the bottom part 73 are released, in that the plate 75 is provided with legs 76 which are then supported on the bottom 77 of the bottom part 73. Upon quick compression of the bellows 56 the plate 75 moves to the upper position, so that the valve 70 is closed. Upon expansion of the bellows 56, the plate 75 returns to the original, lower position again, so that air can be drawn in via the passage 69.

In the condition of rest, air that is displaced when the bellows 56 are compressed sufficiently fast to cause the valve 70 to close, returns via the passages 64, 65 to the surroundings. When the valve 67 is held in the position where the air core 52 communicates with the bellows 56, the displaced air is displaced to the air core 52. Because the overpressure in the empty air core 52 is fairly slight and the passage 69 is much greater than the channel section 63 leading to the air core 2, upon expansion of the bellows 56 mainly air from the surroundings is drawn in. It is also possible, however, to release the valve 67 each time during the expansion of the bellows 56, in order to prevent air escaping from the air core 52 as air is being drawn in by the bellows 56. It is also possible, however, to include a non-return valve in the channel section 63, which prevents air flowing back. In that case, however, provisions are needed to allow air to escape from air cores.

If it is desired to allow air to escape from the air chamber 52, the valve 67 can be set in the position in which the air chamber 52 communicates with the bellows 56. Optionally supported by the loading of the air chamber 52, air can then be allowed to escape from the air chamber 52. Such a slow air flow is not sufficient to move the plate 75 to its upper position, in which the valve 70 is closed.

The invention has been described hereinbefore on the basis of examples in the form of mattresses. However, the examples mentioned, including the body support shown in FIG. 1, can also be designed, when suitably dimensioned, as a different kind of body support which conforms to the shape of the supported portion of the user's body, such as a cushion for a chair or for a couch or as a pillow.

What I claim is:

1. A conforming body support having an outer contour and comprising disposed within said outer contour, an air core, a side edge portion disposed contiguous to the air core and formed from a compliant filling material, and an inflating bellows disposed in a fixed position within said side edge portion and operable to inflate said air core while in said fixed position, said body support having a condition of rest and said inflating bellows being airtightly separated from the air core in said condition of rest, said inflating bellows comprising an inner space and a compliant filling material in said inner space tending to expand said inflating bellows to an expanded state;

said body support further comprising:

a system of passages connecting said bellows with said air core and connecting said bellows and said air core with a surrounding spatial area surrounding the body support, and a valve system for selectively blocking air flow from the air core when said bellows is said condition of rest, the inner space of the bellows being in open communication with the surrounding spatial area via said system of passages when said body support is in said condition of rest.

2. A body support according to claim 1, wherein said system of passages comprises a plurality of individual passages and wherein said open communication of said inner space with the surrounding spatial area is established via a selected one of the passages wherein the bellows is connected to the surrounding spatial area via the selected one of the passages.

3. A body support according to claim 1, wherein said valve system comprises a valve operative to close said open communication between the bellows and the surrounding spatial area.

4. A body support according to claim 3, wherein said valve system is responsive to the operation of said valve to release air flow away from the air core.

5. A body support according to claim 1, wherein said system of passages comprises a single channel between the air core and the surroundings, said single channel providing a pumping passage and a blow-off passage.

6. A body support according to claim 5, wherein said channel comprises a valve having a closed condition for closing off the blow off passage and an opened condition for allowing the passage of air in two opposite directions.

7. A body support according to claim 1, wherein the valve system closes off a single channel between the air core and the surrounding spatial area when said body support is in the condition of rest.

8. A conforming body support having an outer contour and comprising, disposed within said outer contour, an air core, a side edge portion disposed contiguous to the air core and formed from a compliant filling material, and a bellows integrated into said side edge portion, said body support having a condition of rest, said bellows airtightly separated from the air core in said condition of rest, said bellows comprising an inner space and a compliant filling material in the inner space tending to expand said bellows to an expanded state in the inner space, said body support further comprising:

a system of passages connecting said bellows with said air core and connecting said bellows and said air core with a surrounding spatial area surrounding the body support;

a valve system for selectively blocking air flow from the air core when said bellows is said condition of rest, the inner space of the bellows being in open communication with the surrounding spatial area via said system of passages when said body support is in said condition of rest; and a T-piece having legs in directions of the bellows, the air core and the surrounding spatial area and having a valve member which extends in the legs in the direction of the surrounding spatial area and of the air cores for closing off in the condition of rest the leg in the direction of the air core, for closing off in an inflating position the leg in the direction of the surrounding spatial area, and for releasing in a blow-off position the legs in the directions of the surrounding spatial area and of the air core.

* * * * *

UNITED STATES PATENT AND TRADEMARK OFFICE
CERTIFICATE OF CORRECTION

PATENT NO : 6,098,221

DATED : Aug. 8, 2000

INVENTOR(S) : Patrick Kloppenborg

It is certified that an error appears in the above-identified patent and that said Letters Patent are hereby corrected as shown below:

Col. 8, line 23:
after the word "is" insert --in--

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*